US007419409B2

(12) United States Patent
Machida et al.

(10) Patent No.: US 7,419,409 B2
(45) Date of Patent: Sep. 2, 2008

(54) CONNECTION TERMINAL

(75) Inventors: Yukifumi Machida, Tokyo (JP); Yoshikazu Tanaka, Tokyo (JP); Tetsu Hirose, Tokyo (JP)

(73) Assignee: Mitsubishi Cable Industries Ltd., Tokyo (JP)

( * ) Notice: Subject to any disclaimer, the term of this patent is extended or adjusted under 35 U.S.C. 154(b) by 0 days.

(21) Appl. No.: 10/559,997

(22) PCT Filed: Jun. 17, 2004

(86) PCT No.: PCT/JP2004/008538

§ 371 (c)(1),
(2), (4) Date: Nov. 21, 2006

(87) PCT Pub. No.: WO2004/114469

PCT Pub. Date: Dec. 29, 2004

(65) Prior Publication Data

US 2007/0105457 A1 May 10, 2007

(30) Foreign Application Priority Data

Jun. 18, 2003 (JP) ..... 2003-173930

(51) Int. Cl.
*H01R 13/11* (2006.01)

(52) U.S. Cl. ..... 439/852; 439/879

(58) Field of Classification Search ..... 439/877–879
See application file for complete search history.

(56) References Cited

U.S. PATENT DOCUMENTS

| | | | | |
|---|---|---|---|---|
| 5,356,318 | A * | 10/1994 | Fry et al. | 439/877 |
| 5,365,318 | A | 11/1994 | Hiraoka et al. | |
| 5,516,311 | A | 5/1996 | Maejima | |
| 5,964,612 | A * | 10/1999 | Hatagishi | 439/397 |
| 6,302,734 | B1 * | 10/2001 | Ichio et al. | 439/587 |
| 7,121,903 | B2 * | 10/2006 | Sakaguchi et al. | 439/877 |
| 2007/0105457 | A1 * | 5/2007 | Machida et al. | 439/852 |
| 2007/0270050 | A1 * | 11/2007 | Anbo et al. | 439/879 |

FOREIGN PATENT DOCUMENTS

JP 61-204372 U 12/1986

* cited by examiner

*Primary Examiner*—James Harvey
(74) *Attorney, Agent, or Firm*—Frishauf, Holtz, Goodman & Chick, P.C.

(57) ABSTRACT

A connecting terminal 11 has a rectangular tube-like connecting portion 12 formed at a front side for receiving a cooperating tang-like connecting terminal and a U-shaped core conductor clamping portion 13*a* and a U-shaped sheath clamping portion 13*b* at a rear side. In front of the core conductor clamping portion 13*a* near the connecting portion 12 there are formed plate-like locking strips 14 to extend in a longitudinal direction in an upright fashion. A top portion 13*a*' of the core conductor clamping portion 13*a* is coupled substantially linearly with top portions 14' of the locking strips 14 by means of coupling portions 15 to reinforce a root portion of the core conductor clamping portion 13*a*.

5 Claims, 4 Drawing Sheets

CONNECTION TERMINAL

This application is a U.S. National Phase Application under 35 USC 371 of International Application PCT/JP2004/008538 filed Jun. 17, 2004.

TECHNICAL FIELD

The present invention relates to a connecting terminal which is locked within a housing of an electrical connector.

TECHNICAL BACKGROUND

FIG. 8 is a perspective view showing a connecting terminal 1 having an electric wire 2 fixed thereto. A core conductor 4 of the electric wire 2 is clamped in a core conductor clamping portion 3 and a sheath 6 of the electric wire 2 is clamped in a sheath clamping portion 5.

DISCLOSURE OF THE INVENTION

Problems to be Solved by the Invention

In the known connecting terminal 1, after fixing the electric wire 2, the core conductor clamping portion 3 is coupled with a connecting portion 7 via a mere plate-like portion, and therefore a mechanical strength of the plate-like portion is small and if an unexpected force is applied to the connecting terminal, the connecting terminal might be bent or broken.

The present invention has for its object to provide a connecting terminal, in which the above mentioned problems can be removed and a portion between the connecting portion and the core conductor clamping portion can be protected from being damaged.

Means for Solving the Problems

According to the invention, a connecting terminal including a connecting portion, a U-shaped core conductor clamping portion and a U-shaped sheath clamping portion, which are arranged in this order viewed from a front side to a back side, characterized in that plate-like portions are provided on both sides of a portion of the connecting terminal between the connecting portion and the core conductor clamping portion, and top portions of said plate-like portions are substantially linearly coupled with a top portion of the core conductor clamping portion via coupling portions.

Merits of the Invention

In the connecting terminal according to the present invention, since the core conductor clamping portion and the plate-like portions are coupled with each other by means of the coupling portions such that the top portion of the core conductor clamping portion and the top portions of the plate-like portions are coupled with each other substantially linearly, a root portion of the core conductor portion is reinforced and is hardly damaged.

In a preferable embodiment, the plate-like portions are utilized to engage the connecting terminal with a locking lance. Then, the connecting terminal can be effectively prevented from being moved forwardly in a temporarily engaged condition.

EXPLANATION OF REFERENCE NUMERALS

Figure 1:
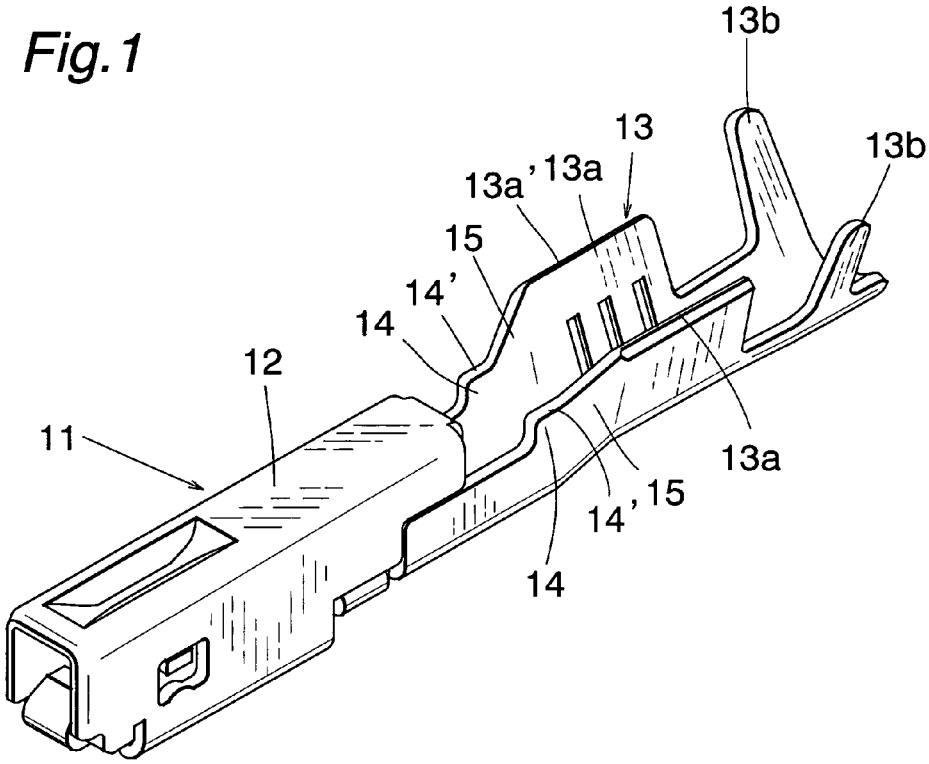
FIG. 1 is a perspective view showing an embodiment of the connecting terminal according to the invention.

11 connecting terminal
12 connecting portion
13 wire clamping portion
13*a* core conductor clamping portion
13*a*', 14' top portion
13*b* sheath clamping portion
14 locking portion
15 coupling portion
21 electric wire
22 core conductor
23 sheath
31 housing
32 rear holder
33 terminal accommodating hole
35 locking lance
35*a* claw portion
35*b* locking recess

BEST MODE OF THE INVENTION

Figure 2:
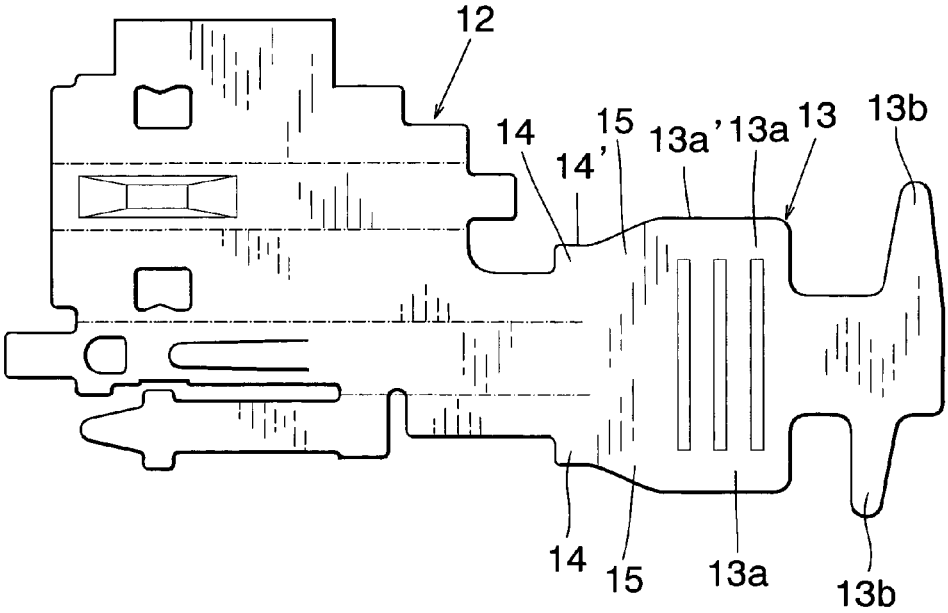
FIG. 2 is an exploded view of the connecting terminal formed by punching a metal plate.

FIG. 1 is a perspective view showing a connecting terminal 11 according to the invention after shaping and FIG. 2 is an exploded view illustrating the connecting terminal 11 being obtained by punching an electrically conductive metal plate before shaping. At a front end of the connecting terminal 11 there is provided a connecting portion 12 of a rectangular tube shape, said connecting portion 12 receiving a cooperating tang-like terminal. At a rear end of the connecting terminal 11 there is provided a U-shaped wire clamping portion 13 for connecting an electric wire. The wire clamping portion 13 includes a core conductor clamping portion 13*a* situating near the connecting portion 12 and a sheath clamping portion 13*b* situating near the rear end. At a front end of the core conductor clamping portion 13*a* near the connecting portion 12, there are provided plate-like locking strips 14 which extend in a longitudinal direction. Top edges 13*a*' of the core conductor clamping portion 13*a* and top edges 14' of the locking strips 14 are linearly coupled with each other by means of coupling portions 15.

Figure 3:
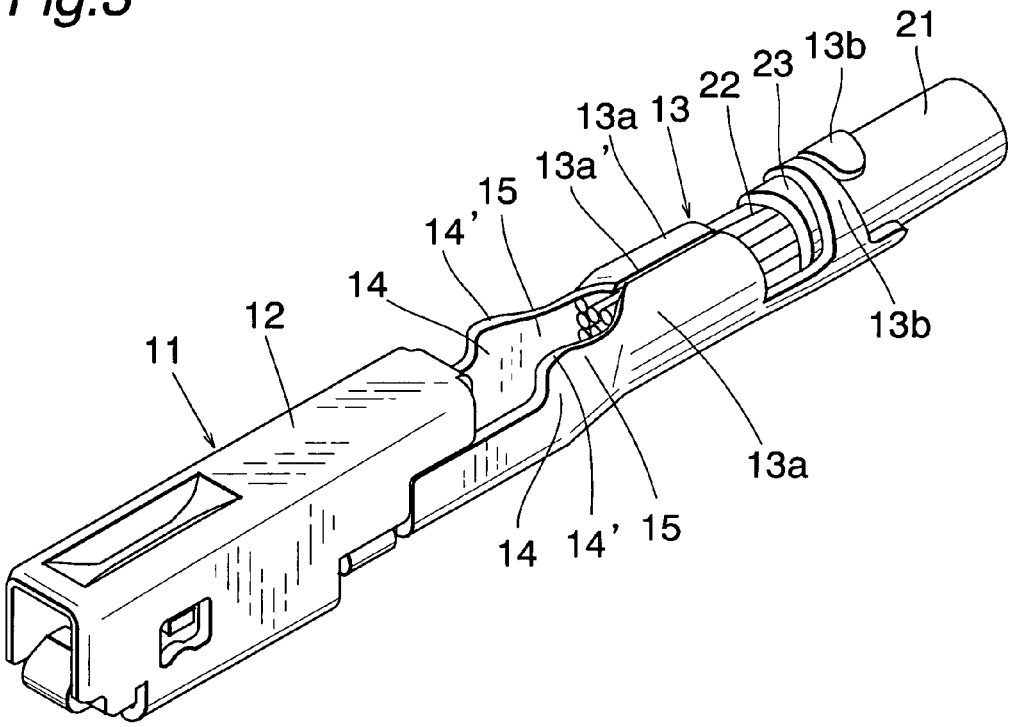
FIG. 3 is a perspective view showing a condition that an electric wire is connected to the connecting terminal.

FIG. 3 is a perspective view showing a condition in which an electric wire 21 is connected to the connecting terminal 11. A core conductor 22 is clamped in the core conductor clamping portion 13*a* by bending side walls of the core conductor clamping portion inwardly. A sheath 23 of the electric wire 21 is clamped in the sheath clamping portion 13*b*. The core conductor clamping portion 13*a* is bent to surround the core conductor 22, but the locking strips 14 still stand upright. The coupling portions 15 are gradually bent from the core conductor clamping portion 13*a*. In this manner, the portion of the connecting terminal 11 between the connecting portion 12 and the core conductor clamping portion 13*a* is reinforced by the locking strips 14 and coupling portions 15.

Figure 4:
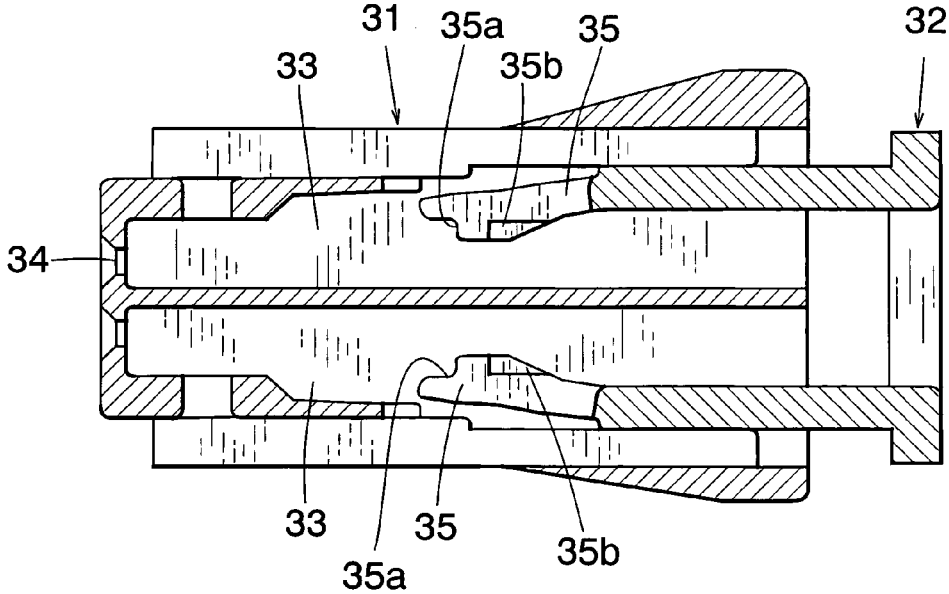
FIG. 4 is a cross sectional view illustrating a condition in which a rear holder is coupled with a housing in a temporarily engaged position.

FIG. 4 is a cross sectional view illustrating a temporarily engaged condition in which a rear holder 32 is inserted halfway into a housing 31 from a rear end. The rear holder 32 is locked within the housing 31 at the temporarily engaged position by means of a temporary engaging mechanism (not shown) . Within the housing 31 there are formed holes 33 for accommodating the connecting terminals 11 in two columns each including a plurality of accommodating holes 33. At a front end of each of the connecting terminal accommodating holes 33, there is formed an opening 34 through which a cooperating male type connecting terminal is inserted.

Figure 5:
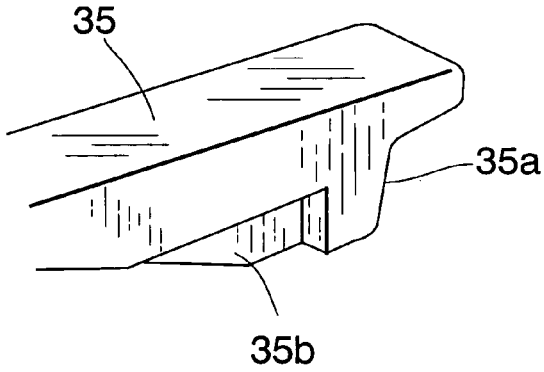
FIG. 5 is a perspective view showing a locking lance.

At each connecting terminal accommodating hole 33 of the rear holder 32, there is formed a resilient locking lancer 35 having a locking claw 35*a* which is engaged with a rear edge of the connecting portion 12 of the connecting terminal 11. Furthermore, as illustrated in FIG. 5, on both side walls of the locking lance 35 there are formed locking recesses 35*b* with which the locking strips 14 of the connecting terminal 11 are engaged to prevent further advance of the connecting terminal 11.

Figure 6:
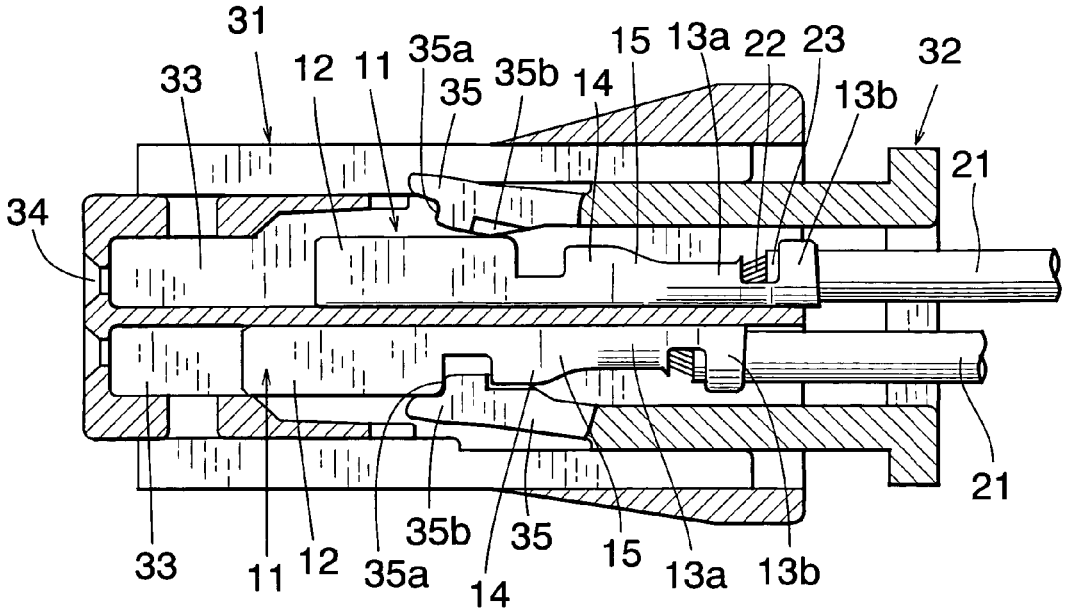
FIG. 6 is a cross sectional view depicting the temporarily engaged condition in which the connecting terminal is inserted into the housing.

In the temporarily engaged condition, when the connecting terminal 11 is inserted into the rear holder 32 from the rear side, the connecting terminal 11 pushes the locking lance 35 upward as depicted in an upper column in FIG. 6. After the connecting terminal 11 has passed through the locking lance 35, the locking lance 35 is returned into the initial position and the claw portion 35*a* of the locking lance 35 is engaged with the rear end of the connecting portion 12 of the connecting terminal 11. At the same time, the locking strips 14 of the connecting terminal 11 are engaged with the locking recesses 35*b* of the locking lance 35.

Due to the engagement of the claw portion 35*a* of the locking lance 35 with the connecting portion 12, the backwardmovement of the connecting terminal 11 is prevented. Furthermore, due to the engagement of the locking strips 14 of the connecting terminal 11 with the locking recesses 35*b*, the forward movement of the connecting terminal 11 is prevented.

Figure 7:
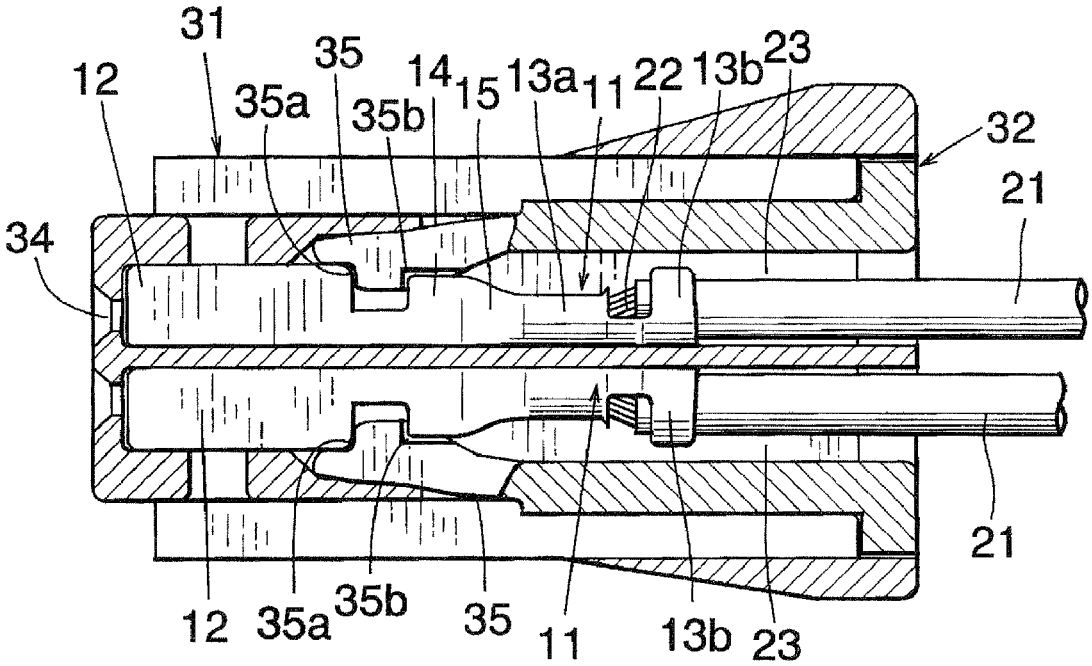
FIG. 7 is a cross sectional view showing a completely engaged condition of the connecting terminal within the housing.
Figure 8:
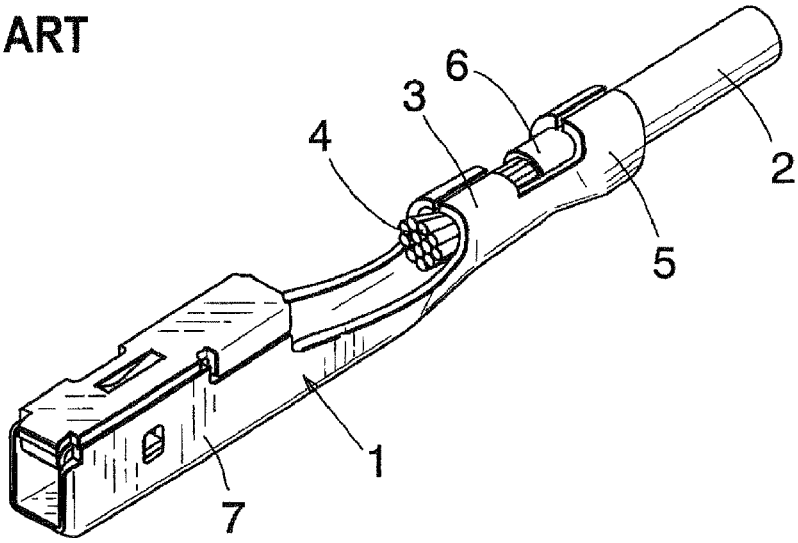
Fig.8 PRIOR ART
FIG. 8 is a perspective view illustrating a known connecting terminal.

In this manner, all connecting terminals 11 are set under the condition in which the forward movement and backward movement of the connecting terminals 11 are restricted by the locking lances 35, a conduction test is performed. After that, the rear holder 32 is pushed into the completely engaged position shown in FIG. 7, the connecting terminals 11 are inserted into given positions within the housing 31.

In the completely engaged condition, the backward movement of the connecting terminals 11 is prevented by the claw portions 35*a* of the locking lances 35 and the forward movement of the connecting terminals 11 is prevented by the front walls in which the openings 34 are formed. It should be noted that the forward movement of the connecting terminals 11 is also prevented by the locking recesses 35*b* of the locking lances 35.

Furthermore, the engagement of the locking strips 14 with the locking recesses 35*b* prevents undesired rolling of the connecting terminals 11, and thus the locking strips 14 also serve as stabilizers.

As explained above, the locking strips 14 are provided in front of the core conductor clamping portion 13*a* and the core conductor clamping portion 13*a* is coupled with the locking strips 14 by means of the coupling portions 15 such that the top portions 13*a*' of the core conductor clamping portion 13*a* and the top portions 14' of the locking strips 14 are coupled with each other substantially linearly, and therefore the front portion of the core conductor clamping portion 13*a* is reinforced and can be effectively prevented from being bent and broken.

What is claimed is:

1. A connecting terminal comprising:

a connecting portion provided at a front side of the connecting terminal;

a U-shaped sheath clamping portion provided at a rear side of the connecting terminal;

a U-shaped core conductor clamping portion provided between the connecting portion and the sheath clamping portion; and plate-like portions provided on both sides of a portion of the connecting terminal between the connecting portion and the core conductor clamping portion, top portions of said plate-like portions being substantially linearly coupled with a top portion of the core conductor clamping portion via coupling portions;

wherein when the connecting terminal is installed within a housing which has a locking lance, said plate-like portions are engaged with locking recesses formed in both side walls of the locking lance.

2. The connecting terminal according to claim 1, wherein a rear end of said connecting portion is locked by the locking lance when the connecting terminal is installed within the housing.

3. A system comprising:

(i) a connecting terminal, which comprises:

a connecting portion provided at a front side of the connecting terminal;

a U-shaped sheath clamping portion provided at a rear side of the connecting terminal;

a U-shaped core conductor clamping portion provided between the connecting portion and the sheath clamping portion; and plate-like portions provided on both sides of a portion of the connecting terminal between the connecting portion and the core conductor clamping portion, top portions of said plate-like portions being substantially linearly coupled with a top portion of the core conductor clamping portion via coupling portions; and (ii) a housing, which comprises:

a hole to accommodate the connecting terminal; and a locking lance having a locking claw, each side wall of the locking claw having a locking recess;

wherein when the connecting terminal is installed within the hole in the housing, said plate-like portions are engaged with the locking recesses formed in the side walls of the locking claw of the locking lance.

4. The system according to claim 3, wherein a rear end of said connecting portion is locked by the locking lance when the connecting terminal is installed within the hole in the housing.

5. The system according to claim 3, wherein the locking lance is provided on a rear holder which is inserted into a body of the housing.

* * * * *